US012630899B2

(12) United States Patent
Jiang et al.

(10) Patent No.: US 12,630,899 B2
(45) Date of Patent: May 19, 2026

(54) REAL-TIME MONITORING SYSTEM AND METHOD FOR COPPER-ARSENIC SULFIDATION SEPARATION IN COPPER ELECTROLYTE PURIFICATION PROCESS

(71) Applicant: TONGJI UNIVERSITY, Shanghai (CN)

(72) Inventors: Linhua Jiang, Shanghai (CN); Ning Duan, Shanghai (CN)

(73) Assignee: TONGJI UNIVERSITY, Shanghai (CN)

( * ) Notice: Subject to any disclaimer, the term of this patent is extended or adjusted under 35 U.S.C. 154(b) by 0 days.

(21) Appl. No.: 19/360,021

(22) Filed: Oct. 16, 2025

(65) Prior Publication Data

US 2026/0055482 A1 Feb. 26, 2026

Related U.S. Application Data

(63) Continuation of application No. PCT/CN2024/115451, filed on Aug. 29, 2024.

(30) Foreign Application Priority Data

Aug. 23, 2024 (CN) ..... 202411161426.5

(51) Int. Cl.

| | |
|---|---|
| ***C22B 15/00*** | (2006.01) |
| ***C22B 3/44*** | (2006.01) |
| ***C22B 30/04*** | (2006.01) |
| ***C25C 3/34*** | (2006.01) |

(52) U.S. Cl.

CPC ..... *C22B 15/0095* (2013.01); *C22B 3/44* (2013.01); *C22B 15/0093* (2013.01); *C22B 30/04* (2013.01); *C25C 3/34* (2013.01)

(58) Field of Classification Search

CPC ... C22B 15/0095; C22B 3/44; C22B 15/0093; C22B 30/04; C25C 3/34

See application file for complete search history.

(56) References Cited

FOREIGN PATENT DOCUMENTS

CN 116121540 A * 5/2023 ..... C22B 7/007

* cited by examiner

*Primary Examiner* — Anthony J Zimmer
*Assistant Examiner* — Syed T Iqbal
(74) *Attorney, Agent, or Firm* — The Dobrusin Law Firm, P.C.

(57) ABSTRACT

A method for monitoring copper-arsenic sulfidation separation in copper electrolyte purification process includes by PLC, timely acquiring changes in copper and arsenic concentrations in first-stage sulfidation monitoring module, determining a critical point where arsenic concentration slightly decreases, and interlocking gas inlet valve to close and liquid outlet valve to open, achieving high-copper precipitation with minor-arsenic precipitation; timely acquiring changes in copper and arsenic concentrations in second-stage sulfidation monitoring module, determining a critical point where copper concentration decreases to near zero, and interlocking gas inlet valve to close and liquid outlet valve to open, achieving complete-copper precipitation with minimal-arsenic precipitation; and timely acquiring changes in copper and arsenic concentrations in third-stage sulfidation monitoring module, determining a critical point where arsenic concentration decreases to a limit value, and interlocking gas inlet valve to close and liquid outlet valve to open, achieving stable arsenic concentration.

8 Claims, 3 Drawing Sheets

REAL-TIME MONITORING SYSTEM AND METHOD FOR COPPER-ARSENIC SULFIDATION SEPARATION IN COPPER ELECTROLYTE PURIFICATION PROCESS

CROSS-REFERENCE TO RELATED APPLICATION

This application is a continuation application of International Patent Application No. PCT/CN2024/115451, filed on Aug. 29, 2024, which claims priority of Chinese Patent Application No. 202411161426.5 filed with the China National Intellectual Property Administration on Aug. 23, 2024, both of which are incorporated by reference herein in their entities as part of the present application.

TECHNICAL FIELD

The present disclosure belongs to an electrolytic refining purification system in the copper smelting industry, relates to the technical field of clean production in the copper-arsenic sulfidation separation process, and particularly relates to a real-time monitoring system and method for copper-arsenic sulfidation separation in a copper electrolyte purification process.

BACKGROUND

Since the inception of the copper smelting industry, the electrolytic refining purification system in the copper smelting industry have persistently failed to achieve efficient copper-arsenic separation, which leads to significant copper entrainment mixed in arsenic residues and arsenic contamination mixed in copper residues, generating excessive volumes of arsenic-containing hazardous waste annually with an increase of 200,000 tons, which has become the most prominent major problem in the industry. The copper electrolytic refining purification system mainly includes two methods: electrowinning arsenic removal and sulfidation arsenic removal. The electrowinning arsenic removal is the most conventional electrolyte purification method in the industry. However, co-deposition readily occurs due to similar electrode potentials of copper and arsenic, causing ineffective separation, and the production process is easy to produce toxic and harmful gas such as hydrogen arsenide, which endangers safety in production. Therefore, many manufacturers and research institutions are actively seeking new methods for copper electrolyte purification instead of the electrowinning arsenic removal method. The sulfidation arsenic removal, as a new purification process, has gradually emerged and been widely used in the copper smelting industry. However, both a second stage copper-arsenic sulfidation separation process and a third stage copper-arsenic sulfidation separation process with more advanced design concept have not yet solved the problems of high arsenic content in the primary and secondary sulfidation residues, high copper content in the tertiary sulfidation residues, low recovery rate of copper resource, and excessive production of arsenic-containing hazardous waste.

The copper-arsenic sulfidation reaction proceeds rapidly (in seconds), but current mainstream equipment requires an overly long detection time (2-4 hours), which makes it impossible to adjust the dosage of hydrogen sulfide in real time according to the concentrations of individual species. The overdosing of hydrogen sulfide induces co-precipitation of copper and arsenic, resulting in arsenic contamination in copper precipitates, and copper entrainment in arsenic residues. Enterprises urgently require technologies and methods for real-time monitoring of copper and arsenic concentrations in a liquid phase during sulfidation reaction, and accurate control of reaction endpoint. Therefore, a real-time monitoring system and method for copper-arsenic sulfidation separation in a copper electrolyte purification process is an urgent need for enterprises to achieve effective copper-arsenic separation in electrolyte purification, improve a reuse rate of copper resource, cut down the production of arsenic-containing hazardous waste, reduce the emission of toxic gases, and promote energy conservation, consumption reduction, pollution control, and efficiency gain.

SUMMARY

As both electrowinning and sulfidation arsenic removal methods employed in the current electrolytic refining purification system of the copper smelting industry have the problems of low recovery rate of copper resource, excessive production of arsenic-containing hazardous waste and inability to timely monitor copper and arsenic concentrations in a liquid phase and accurately control a reaction endpoint during the sulfidation reaction, the present disclosure provides a real-time monitoring system and method for copper-arsenic sulfidation separation in a copper electrolyte purification process, which can scientifically guide the accurate addition of hydrogen sulfide, improve the utilization efficiency of copper resource, and reduce the production of arsenic-containing hazardous waste through a reasonably designed three-stage sulfidation reaction process and accurate control of PLC (Programmable logic controller) on the reaction process.

To achieve the above objective, the present disclosure employs the technical solutions as follows.

In a first aspect, the present disclosure provides a real-time monitoring method for copper-arsenic sulfidation separation in a copper electrolyte purification process.

The method, based on a three-stage copper-arsenic sulfidation reaction process, includes the following steps:

during a first stage copper-arsenic sulfidation reaction process, monitoring changes in copper and arsenic ion concentrations in the first stage copper-arsenic sulfidation reaction process in real time; by a PLC, calculating and determining a critical point where an arsenic concentration slightly decreases, and interlocking a gas inlet valve to close, and a liquid outlet valve to open, to achieve high copper precipitation with minor arsenic precipitation in a sulfidation liquid discharged from the first stage copper-arsenic sulfidation reaction process;

during a second stage copper-arsenic sulfidation reaction process, monitoring changes in copper and arsenic ion concentrations in the second stage copper-arsenic sulfidation reaction process in real time; by the PLC, calculating and determining a critical point where a copper concentration decreases to near zero, and interlocking a gas inlet valve to close, and a liquid outlet valve to open, to achieve complete copper precipitation with minimal arsenic precipitation in a sulfidation liquid discharged from the second stage copper-arsenic sulfidation reaction process; and during a third stage copper-arsenic sulfidation reaction process, monitoring changes in copper and arsenic ion concentrations in the third stage copper-arsenic sulfidation reaction process in real time; by the PLC, calculating and determining a critical point where the arsenic concentration decreases to a limit value, and interlocking a gas inlet valve to close, and a liquid outlet valve to open, to ensure that the arsenic concentration in a sulfidation liquid discharged from the third stage copper-arsenic sulfidation reaction process remains consistently within a compliance limit.

In a specific implementation, during the first stage copper-arsenic sulfidation reaction process, the changes in copper and arsenic ion concentrations over time in a first stage sulfidation reaction tank are monitored in real time, where the changes include a variation of the copper ion over sulfidation time from liquid inlet to liquid outlet and a variation of the arsenic ion over sulfidation time from liquid inlet to liquid outlet, and data is transmitted to the PLC in real time; when analyzing and determining the critical point where the arsenic ion concentration slightly decreases in the first stage copper-arsenic sulfidation reaction process, the PLC interlocks the gas inlet valve of the first stage sulfidation reaction tank to close, and the liquid outlet valve of the first stage sulfidation reaction tank to open to terminate the reaction, thereby ensuring high copper precipitation with minor arsenic precipitation in the discharged first stage sulfidation liquid. The critical point of slight decrease is that arsenic content is less than or equal to 2.5%.

In a specific implementation, during the second stage copper-arsenic sulfidation reaction process, the changes in copper and arsenic ion concentrations over time in a second stage sulfidation reaction tank are monitored in real time, where the changes include a variation of the copper ion over sulfidation time from liquid inlet to liquid outlet and a variation of the arsenic ion over sulfidation time from liquid inlet to liquid outlet, and data is transmitted to the PLC in real time; when analyzing and determining the critical point where the copper ion concentration decreases to near zero in the second stage copper-arsenic sulfidation reaction process, the PLC interlocks the gas inlet valve of the second stage sulfidation reaction tank to close, and the liquid outlet valve of the second stage sulfidation reaction tank to open to terminate the reaction, thereby ensuring complete copper precipitation with minimal arsenic precipitation in the discharged second stage sulfidation liquid. The critical point is that the copper concentration is 0 mg/L.

In a specific implementation, during the third stage copper-arsenic sulfidation reaction process, the changes in copper and arsenic ion concentrations over time in a third stage sulfidation reaction tank are monitored in real time, where the changes include a variation of the copper ion over sulfidation time from liquid inlet to liquid outlet and a variation of the arsenic ion over sulfidation time from liquid inlet to liquid outlet, and data is transmitted to the PLC in real time; when analyzing and determining the critical point where the arsenic ion concentration decreases to the limit value in the third stage copper-arsenic sulfidation reaction process, the PLC interlocks the gas inlet valve of the third stage sulfidation reaction tank to close, and the liquid outlet valve of the third stage sulfidation reaction tank to open to terminate the reaction, thereby ensuring that the arsenic concentration in the discharged third stage sulfidation liquid remains consistently within the compliance limit. The critical point is that the arsenic concentration is 1000 mg/L.

In a second aspect, the present disclosure provides a real-time monitoring system for copper-arsenic sulfidation separation in a copper electrolyte purification process.

The system includes a first stage sulfidation reaction tank, a second stage sulfidation reaction tank, and a third stage sulfidation reaction tank, and further includes a PLC reaction control module, a first stage sulfidation real-time monitoring module, a second stage sulfidation real-time monitoring module, a third stage sulfidation real-time monitoring module, and a hydrogen sulfide inlet valve and sulfidation liquid outlet valve.

The PLC reaction control module includes a first stage sulfidation copper-arsenic reaction closed-loop control module, a second stage sulfidation copper-arsenic reaction closed-loop control module, and a third stage sulfidation copper-arsenic reaction closed-loop control module.

The first stage sulfidation copper-arsenic reaction closed-loop control module is in communication and electrical connection with the first stage sulfidation real-time monitoring module and the hydrogen sulfide inlet valve and sulfidation liquid outlet valve, and is configured to retrieve copper and arsenic ion concentrations of the first stage sulfidation real-time monitoring module in real time, and to interlock a first stage sulfidation reaction tank hydrogen sulfide inlet electromagnetic valve in the hydrogen sulfide inlet valve and sulfidation liquid outlet valve to close and a first stage sulfidation reaction tank sulfidation liquid outlet ball valve in the hydrogen sulfide inlet valve and sulfidation liquid outlet valve to open when analyzing and determining a critical point where the arsenic ion concentration slightly decreases in a first stage sulfidation process, thereby terminating the reaction.

The second stage sulfidation copper-arsenic reaction closed-loop control module is in communication and electrical connection with the second stage sulfidation real-time monitoring module and the hydrogen sulfide inlet valve and sulfidation liquid outlet valve, and is configured to retrieve copper and arsenic ion concentrations of the second stage sulfidation real-time monitoring module in real time, and to interlock a second stage sulfidation reaction tank hydrogen sulfide inlet electromagnetic valve in the hydrogen sulfide inlet valve and sulfidation liquid outlet valve to close and a second stage sulfidation reaction tank sulfidation liquid outlet ball valve in the hydrogen sulfide inlet valve and sulfidation liquid outlet valve to open when analyzing and determining a critical point where the copper ion concentration decreases to near zero in a second stage sulfidation process, thereby terminating the reaction.

The third stage sulfidation copper-arsenic reaction closed-loop control module is in communication and electrical connection with the third stage sulfidation real-time monitoring module and the hydrogen sulfide inlet valve and sulfidation liquid outlet valve, and is configured to retrieve copper and arsenic ion concentrations of the third stage sulfidation real-time monitoring module in real time, and to interlock a third stage sulfidation reaction tank hydrogen sulfide inlet electromagnetic valve in the hydrogen sulfide inlet valve and sulfidation liquid outlet valve to close and a third stage sulfidation reaction tank sulfidation liquid outlet ball valve in the hydrogen sulfide inlet valve and sulfidation liquid outlet valve to open when analyzing and determining a critical point where the arsenic ion concentration decreases to a limit value in a third stage sulfidation process, thereby terminating the reaction.

The first stage sulfidation real-time monitoring module is mounted at the first stage sulfidation reaction tank, and configured to monitor the changes in copper and arsenic ion concentrations over time in the first stage sulfidation process, with a focus on monitoring the critical point where the arsenic ion concentration starts to slightly decrease, where a corresponding reaction time of the critical point is a reaction endpoint draining time; to monitor a variation of the copper ion over sulfidation time from liquid inlet to liquid outlet and a variation of the arsenic ion over the sulfidation time from liquid inlet to liquid outlet in real time, and transmit data to the first stage sulfidation copper-arsenic reaction closed-loop control module in the PLC reaction control module in real time.

The second stage sulfidation real-time monitoring module is mounted at the second stage sulfidation reaction tank, and configured to monitor the changes in copper and arsenic ion concentrations over time in the second stage sulfidation process, with a focus on monitoring the critical point where the copper ion concentration decreases to near zero, where a corresponding reaction time of the critical point is the reaction endpoint draining time; to monitor the variation of the copper ion over the sulfidation time from liquid inlet to liquid outlet and the variation of the arsenic ion over the sulfidation time from liquid inlet to liquid outlet in real time, and transmit data to the second stage sulfidation copper-arsenic reaction closed-loop control module in the PLC reaction control module in real time.

The third stage sulfidation real-time monitoring module is mounted at the third stage sulfidation reaction tank, and configured to monitor the changes in copper and arsenic ion concentrations over time in the third stage sulfidation process, with a focus on monitoring the critical point where the arsenic ion concentration decreases to the limit value, where a corresponding reaction time of the critical point is the reaction endpoint draining time; to monitor the variation of the copper ion over the sulfidation time from liquid inlet to liquid outlet and the variation of the arsenic ion over the sulfidation time from liquid inlet to liquid outlet in real time, and transmit data to the third stage sulfidation copper-arsenic reaction closed-loop control module in the PLC reaction control module in real time.

The hydrogen sulfide inlet valve and sulfidation liquid outlet valve includes the first stage sulfidation reaction tank hydrogen sulfide inlet electromagnetic valve and the first stage sulfidation reaction tank sulfidation liquid outlet ball valve, the second stage sulfidation reaction tank hydrogen sulfide inlet electromagnetic valve and the second stage sulfidation reaction tank sulfidation liquid outlet ball valve, and the third stage sulfidation reaction tank hydrogen sulfide inlet electromagnetic valve and the third stage sulfidation reaction tank sulfidation liquid outlet ball valve.

The first stage sulfidation reaction tank hydrogen sulfide inlet electromagnetic valve and the first stage sulfidation reaction tank sulfidation liquid outlet ball valve are mounted at the first stage sulfidation reaction tank, and are correspondingly opened and closed in response to an instruction from the first stage sulfidation copper-arsenic reaction closed-loop control module in the PLC reaction control module.

The second stage sulfidation reaction tank hydrogen sulfide inlet electromagnetic valve and the second stage sulfidation reaction tank sulfidation liquid outlet ball valve are mounted at the second stage sulfidation reaction tank, and are correspondingly opened and closed in response to an instruction from the second stage sulfidation copper-arsenic reaction closed-loop control module in the PLC reaction control module.

The third stage sulfidation reaction tank hydrogen sulfide inlet electromagnetic valve and the third stage sulfidation reaction tank sulfidation liquid outlet ball valve are mounted at the third stage sulfidation reaction tank, and are correspondingly opened and closed in response to an instruction from the third stage sulfidation copper-arsenic reaction closed-loop control module in the PLC reaction control module.

The present disclosure has remarkable effects as follows.

The present disclosure provides a real-time monitoring system and method for copper-arsenic sulfidation separation in a copper electrolyte purification process, including a PLC reaction control module, a first stage sulfidation real-time monitoring module, a second stage sulfidation real-time monitoring module, a third stage sulfidation real-time monitoring module, and a hydrogen sulfide inlet valve and sulfidation liquid outlet valve. Based on basic characteristics that copper is preferentially precipitated over arsenic in the copper-arsenic sulfidation process, a critical point where an arsenic concentration slightly decreases in the first stage copper-arsenic sulfidation process is monitored, and PLC is used to interlock a gas inlet valve to close and a liquid outlet valve to open, to ensure high copper precipitation with minor arsenic precipitation in the first stage sulfidation liquid. A critical point where a copper concentration decreases to near zero in the second stage copper-arsenic sulfidation process is monitored, and the PLC is used to interlock a gas inlet valve to close and a liquid outlet valve to open, to ensure complete copper precipitation with minimal arsenic precipitation in the second stage sulfidation liquid. A critical point where the arsenic concentration decreases to 1000 mg/L in the third stage copper-arsenic sulfidation process is monitored, and the PLC is used to interlock a gas inlet valve to close and a liquid outlet valve to open, to ensure that the arsenic concentration in the third stage sulfidation liquid remains consistently within the compliance limit. The present disclosure can achieve scientific guidance on accurate addition of hydrogen sulfide, improve the utilization efficiency of copper resource and reduce the generation of arsenic-containing hazardous waste.

DETAILED DESCRIPTION OF THE EMBODIMENTS

To make the objectives, technical solutions and advantages of embodiments of the present disclosure more clearly, the technical solutions in the embodiments are described clearly and completely below with reference to accompanying drawings in the embodiments of the present disclosure. The following embodiments are used for the description of the present disclosure.

Figure 1:
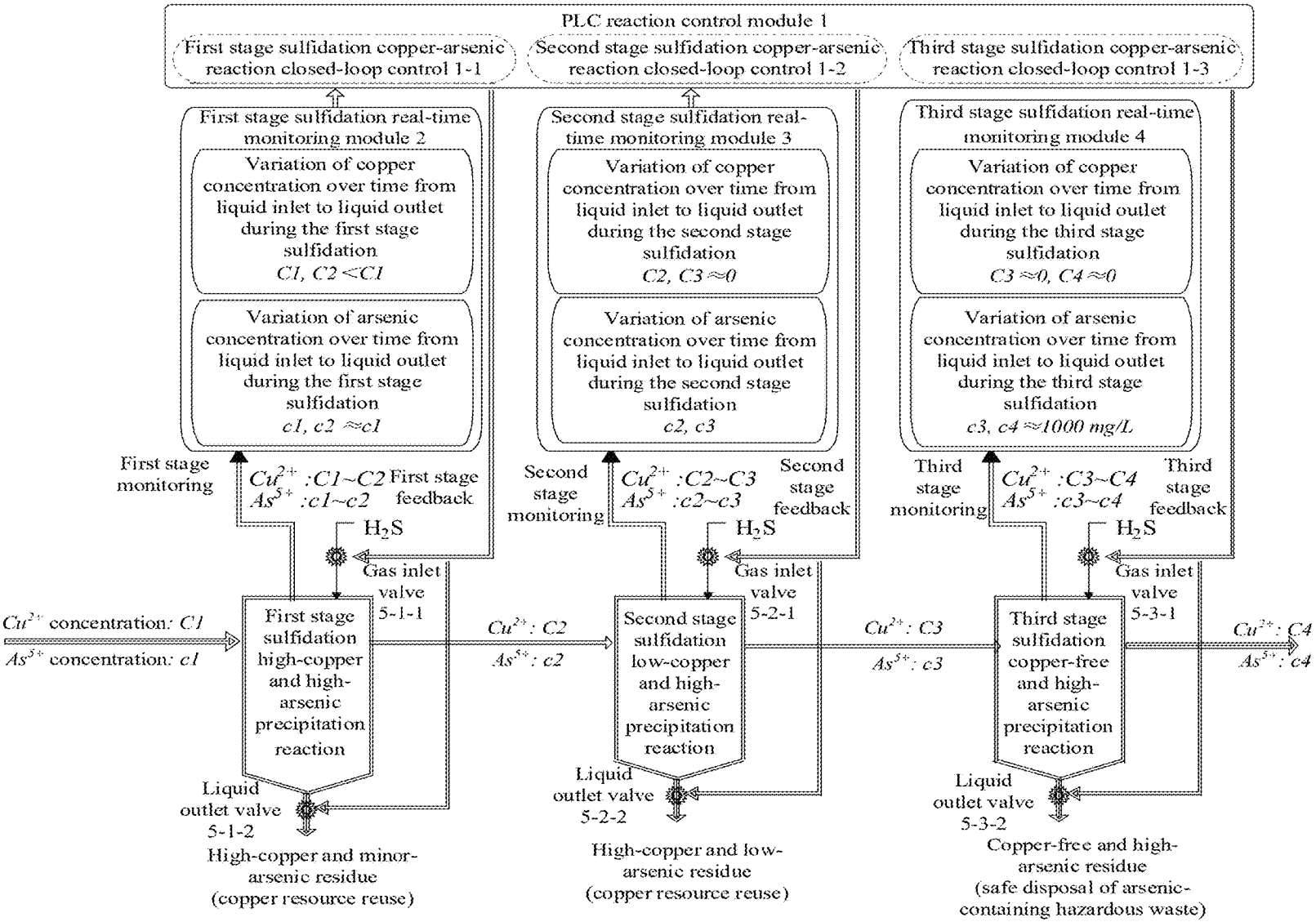
FIG. 1 is a system block diagram and a control route diagram according to the present disclosure.

With reference to FIG. 1, a system according to the present disclosure includes a PLC reaction control module 1, a first stage sulfidation real-time monitoring module 2, a second stage sulfidation real-time monitoring module 3, a third stage sulfidation real-time monitoring module 4, and a hydrogen sulfide inlet valve and sulfidation liquid outlet valve 5.

With reference to FIG. 1, the PLC reaction control module 1 includes a first stage sulfidation copper-arsenic reaction closed-loop control module 1-1, a second stage sulfidation copper-arsenic reaction closed-loop control module 1-2, and a third stage sulfidation copper-arsenic reaction closed-loop control module 1-3. The first stage sulfidation copper-arsenic reaction closed-loop control module 1-1 is configured to retrieve copper and arsenic ion concentrations of the first stage sulfidation real-time monitoring module 2 in real time, and rapidly actuate PLC interlocking to close a gas inlet valve and open a liquid outlet valve of a first stage sulfidation tank for terminating the reaction when analyzing and determining a critical point where an arsenic ion concentration in the first stage sulfidation process slightly decreases (solid phase As≈2.5%), thereby ensuring high copper precipitation with minor arsenic precipitation in a first stage sulfidation liquid. The second stage sulfidation copper-arsenic reaction closed-loop control module 1-2 is configured to retrieve copper and arsenic ion concentrations of the second stage sulfidation real-time monitoring module 3 in real time, and rapidly actuate the PLC interlocking to close a gas inlet valve and open a liquid outlet valve of a second stage sulfidation tank for terminating the reaction when analyzing and determining a critical point where a copper ion concentration in the second stage sulfidation process decreases to near zero (Cu≈0 mg/L), thereby ensuring complete copper precipitation with minimal arsenic precipitation in a second stage sulfidation liquid. The third stage sulfidation copper-arsenic reaction closed-loop control module 1-3 is configured to retrieve copper and arsenic ion concentrations of the third stage sulfidation real-time monitoring module 4 in real time, and rapidly actuate the PLC interlocking to close a gas inlet valve and open a liquid outlet valve of a third stage sulfidation tank for terminating the reaction when analyzing and determining a critical point where the arsenic ion concentration in the third stage sulfidation process decreases to a limit value (for example, As≈1000 mg/L), thereby ensuring that the arsenic concentration in a third stage sulfidation liquid remains consistently within a compliance limit.

With reference to FIG. 1, the first stage sulfidation real-time monitoring module 2 is mounted at the first stage sulfidation reaction tank, and configured to monitor changes in copper and arsenic ion concentrations over time in the first stage sulfidation process, and particularly monitor a critical point where the arsenic concentration starts to slightly decrease (solid phase As ≈2.5%), of which a corresponding reaction time t=x1 min, that is, a reaction endpoint draining time. The variation of the copper ion over sulfidation time from liquid inlet C1 to liquid outlet C2 and the variation of the arsenic ion over sulfidation time from liquid inlet c1 to liquid outlet c2 are monitored in real time, and the monitored data is transmitted to the first stage sulfidation copper-arsenic reaction closed-loop control module 1-1 in real time.

With reference to FIG. 1, the second stage sulfidation real-time monitoring module 3 is mounted at the second stage sulfidation reaction tank, and configured to monitor changes in copper and arsenic ion concentrations over time in the second stage sulfidation process, and particularly monitor a critical point where the copper concentration decreases to near zero (Cu≈0 mg/L), of which a corresponding reaction time t=x2 min, that is, the reaction endpoint draining time. The variation of the copper ion over sulfidation time from liquid inlet C2 to liquid outlet C3 and the variation of the arsenic ion over sulfidation time from liquid inlet c2 to liquid outlet c3 are monitored in real time, and the monitored data is transmitted to the second stage sulfidation copper-arsenic reaction closed-loop control module 1-2 in real time.

With reference to FIG. 1, the third stage sulfidation real-time monitoring module 4 is mounted at the third stage sulfidation reaction tank, and configured to monitor changes in copper and arsenic ion concentrations over time in the third stage sulfidation process, and particularly monitor a critical point where the arsenic concentration decreases to the limit value (As≈1000 mg/L), of which a corresponding reaction time t=x3 min, that is, the reaction endpoint draining time. The variation of the copper ion over sulfidation time from liquid inlet C3 to liquid outlet C4 and the variation of the arsenic ion over sulfidation time from liquid inlet c3 to liquid outlet c4 are monitored in real time, and the monitored data is transmitted to the third stage sulfidation copper-arsenic reaction closed-loop control module 1-3 in real time.

With reference to FIG. 1, the hydrogen sulfide inlet valve and sulfidation liquid outlet valve 5 includes a first stage sulfidation reaction tank hydrogen sulfide inlet electromagnetic valve 5-1-1 and a first stage sulfidation reaction tank sulfidation liquid outlet ball valve 5-1-2 mounted at the first stage sulfidation reaction tank, a second stage sulfidation reaction tank hydrogen sulfide inlet electromagnetic valve 5-2-1 and a second stage sulfidation reaction tank sulfidation liquid outlet ball valve 5-2-2 mounted at the second stage sulfidation reaction tank, and a third stage sulfidation reaction tank hydrogen sulfide inlet electromagnetic valve 5-3-1 and a third stage sulfidation reaction tank sulfidation liquid outlet ball valve 5-3-2 mounted at the third stage sulfidation reaction tank. The foregoing valve groups can be correspondingly opened and closed in response to instructions from the first stage sulfidation copper-arsenic reaction closed-loop control module 1-1, the second stage sulfidation copper-arsenic reaction closed-loop control module 1-2 and the third stage sulfidation copper-arsenic reaction closed-loop control module 1-3 in the PLC reaction control module 1, respectively.

In conclusion, the three-stage sulfidation reaction process according to the present disclosure is closely related to the on-site process conditions, which can be understood that the first stage sulfidation reaction removes high copper content, the second stage sulfidation reaction removes low copper content, and the third stage sulfidation reaction removes high arsenic content. In the first stage sulfidation reaction, the copper content is reduced by approximately 80-90%. In the second stage sulfidation reaction, a remaining 10-20% of copper can be precipitated. In the third stage sulfidation reaction, arsenic is removed exclusively since there is no copper and only arsenic remains. An objective of the three-stage sulfidation reaction according to the present disclosure is to effectively separate the high-concentration copper and arsenic ions in an electrolyte into a copper precipitate and an arsenic residue through stepwise sulfidation precipitation.

EMBODIMENT

Based on the sulfide solubility product principle, in the condition of proper amount of $H_2S$, $Cu^{2+}$ is more prone to sulfide precipitation than $As^{5+}$. By utilizing this characteristic, the addition of $H_2S$ allows $S^{2-}$ to first precipitate with $Cu^{2+}$ and then with $As^{5+}$, which is the theoretical basis for the sulfidation-based copper and arsenic removal.

Specifically, copper sulfidation reaction is shown in Equation (1), and arsenic sulfidation reaction is shown in Equation (2):

$$Cu^{2+} + S^{2-} \rightarrow CuS \downarrow \quad (1)$$

$$2As^{5+} + 5S^{2-} \rightarrow As_2S_3 \downarrow + 2S \downarrow \quad (2)$$

Noted: Cu has a relative atomic mass of 64, As has a relative atomic mass of 75, and S has a relative atomic mass of 32.

1. First Stage Sulfidation Reaction Process

Copper enters the purification system for electrolytic refining. In an electrolyte before the first stage sulfidation reaction, the copper ion ($Cu^{2+}$) concentration is approximately 10000 mg/L, and the arsenic ion ($As^{5+}$) concentration is approximately 9000 mg/L. The details are shown in Table 1.

TABLE 1

Copper and arsenic ion concentrations before the first stage sulfidation

| Species concentration (mg/L) | Time (t) 0 min |
|---|---|
| Copper ion ($Cu^{2+}$) concentration: C1 | 10000 |
| Arsenic ion ($As^{5+}$) concentration: c1 | 9000 |

Firstly, an electrolyte containing high concentrations of copper and arsenic is pumped into the first stage sulfidation reaction tank, and hydrogen sulfide gas is slowly added for sulfidation reaction while the electrolyte is stirred vigorously.

In the first stage sulfidation reaction process, the changes in copper and arsenic ion concentrations need to be monitored in real time, and the monitored data is fed back to the PLC reaction control module in real time, and it is determined whether a sulfidation reaction endpoint has been reached (limit requirement: the solid-phase arsenic content: As≤2.5%) by rapidly calculating and analyzing the arsenic content in residues, thereby ensuring high copper precipitation with minor arsenic precipitation in the first stage sulfidation liquid. The variations of copper and arsenic ion concentrations monitored in real time in the first stage sulfidation reaction are shown in FIG. 2.

Figure 2:
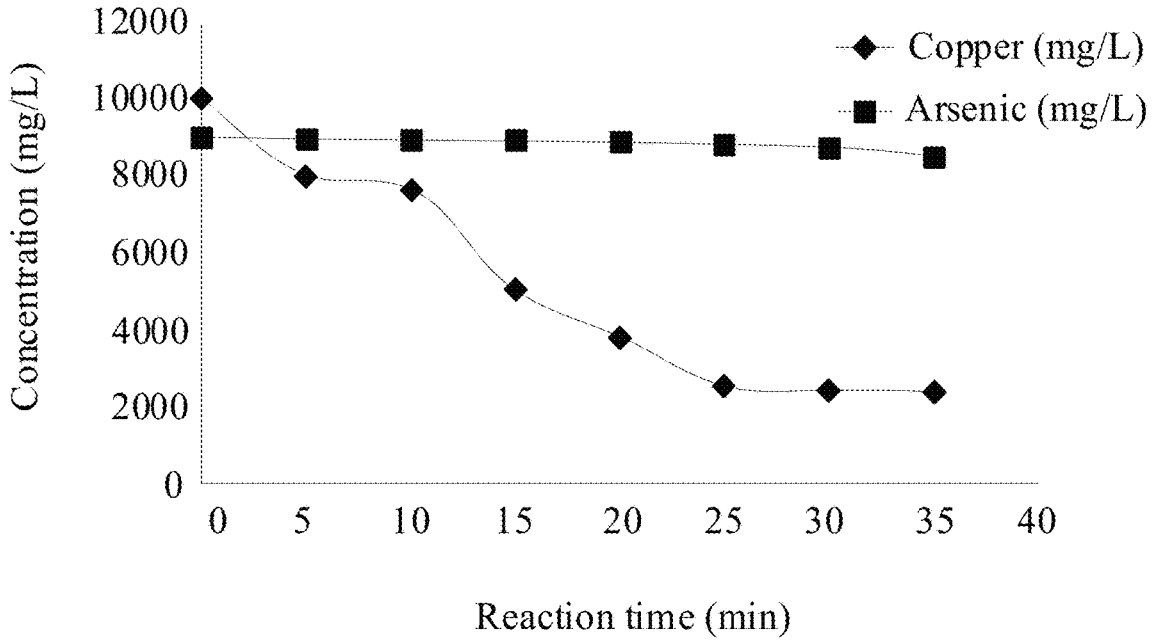
FIG. 2 is a diagram showing changes in copper and arsenic ion concentrations monitored in real time during a first stage sulfidation reaction according to an embodiment of the present disclosure.

Several representative time points are selected from FIG. 2 (see Table 2) for preliminary calculation for determining whether the first stage sulfidation reaction has reached the endpoint.

TABLE 2

Changes in copper and arsenic ion concentrations monitored in real time in the first stage sulfidation reaction

| Species concentration | Time (t) | | | |
|---|---|---|---|---|
| (mg/L) | 0 min | 15 min | 25 min | 30 min |
| Copper ion ($Cu^{2+}$) concentration: C1 | 10000 | 5000 | 2500 | 2400 |
| Arsenic ion ($As^{5+}$) concentration: c1 | 9000 | 8900 | 8800 | 8700 |

It can be inferred from above formula that a residue phase obtained from the sulfidation reaction is mainly composed of CuS, $As_2S_3$ and S, and a limit value of the first stage sulfidation reaction requires that a proportion of As content in the residue phase≤2.5%.

$$\text{That is: } \frac{As}{CuS + As_2S_3 + 2S} \times 100\% < 2.5\% \quad (3)$$

(1) When t=15 min, $Cu^{2+}$ consumed in the reaction precipitation is that $Cu^{2+}$=(10000-5000) mg/L=5000 mg/L, and $As^{5+}$ consumed in the reaction precipitation is that: $As^{5+}$=(9000-8900) mg/L=100 mg/L.

The Cu and As concentrations consumed in the reaction process can be substituted into Formula 3 to obtain:

$$\frac{100}{5000 \times \frac{64+32}{64} + 100 \times \frac{75 \times 2 + 32 \times 3}{75 \times 2} + 100 \times \frac{32 \times 2}{75 \times 2}} \times 100\% = \frac{100}{5000 \times 1.5 + 100 \times 1.64 + 100 \times 0.43} \times 100\% = 1.30\%$$

since 1.30%<2.5% (the limit value), the sulfidation endpoint has not been reached, and the sulfidation reaction continues.

(2) When t=25 min, $Cu^{2+}$ consumed in the reaction precipitation is $Cu^{2+}$=(10000-2500) mg/L=7500 mg/L, and $As^{5+}$ consumed in the reaction precipitation is that: $As^{5+}$=(9000-8800) mg/L=200 mg/L.

The Cu and As concentrations consumed in the reaction process can be introduced into Formula 3 to obtain:

$$\frac{200}{7500 \times \frac{64+32}{64} + 200 \times \frac{75 \times 2 + 32 \times 3}{75 \times 2} + 200 \times \frac{32 \times 2}{75 \times 2}} \times 100\% = \frac{200}{7500 \times 1.5 + 200 \times 1.64 + 200 \times 0.43} \times 100\% = 1.72\%$$

since 1.72%<2.5% (the limit value), the sulfidation endpoint has not been reached, and the sulfidation reaction continues.

(3) When t=30 min, $Cu^{2+}$ consumed in the reaction precipitation is that $Cu^{2+}$=(10000-2400) mg/L=7600 mg/L, and $As^{5+}$ consumed in the reaction precipitation is that: $As^{5+}$=(9000-8700) mg/L=300 mg/L.

The Cu and As concentrations consumed in the reaction process can be introduced into Formula 3 to obtain:

$$\frac{300}{7600 \times \frac{64+32}{64} + 300 \times \frac{75 \times 2 + 32 \times 3}{75 \times 2} + 300 \times \frac{32 \times 2}{75 \times 2}} \times 100\% = \frac{300}{7600 \times 1.5 + 300 \times 1.64 + 300 \times 0.43} \times 100\% = 2.49\%$$

since 2.49%≈2.5% (the limit value), the sulfidation endpoint has been approached, and the reaction needs to be terminated for draining and pressure filtration.

2. Second Stage Sulfidation Reaction Process

An electrolyte after the first stage sulfidation is liquid before the second stage sulfidation reaction, with copper and arsenic ion concentrations shown in Table 3.

TABLE 3

| Copper and arsenic ion concentrations in the electrolyte before the second stage sulfidation | |
|---|---|
| Species concentration (mg/L) | Time (t) 0 min |
| Copper ion ($Cu^{2+}$) concentration: C1 | 2400 |
| Arsenic ion ($As^{5+}$) concentration: c1 | 8700 |

Then, the liquid containing a certain concentration of copper and arsenic ions after the first stage sulfidation is pumped into the second stage sulfidation reaction tank, and hydrogen sulfide gas is slowly added for sulfidation reaction while the liquid is stirred vigorously.

In the second stage sulfidation reaction process, the changes in copper and arsenic ion concentrations need to be monitored in real time, and the monitored data is fed back to the PLC reaction control module in real time, and it is determined whether a sulfidation reaction endpoint has been reached (limit requirement: the liquid-phase copper concentration: $Cu^{2+}\approx 0$ mg/L) by rapid calculation and analysis, thereby ensuring complete copper precipitation with minimal arsenic precipitation in the second stage sulfidation liquid. The variations of copper and arsenic ion concentrations monitored in real time in the second stage sulfidation reaction are shown in FIG. 3.

Figure 3:
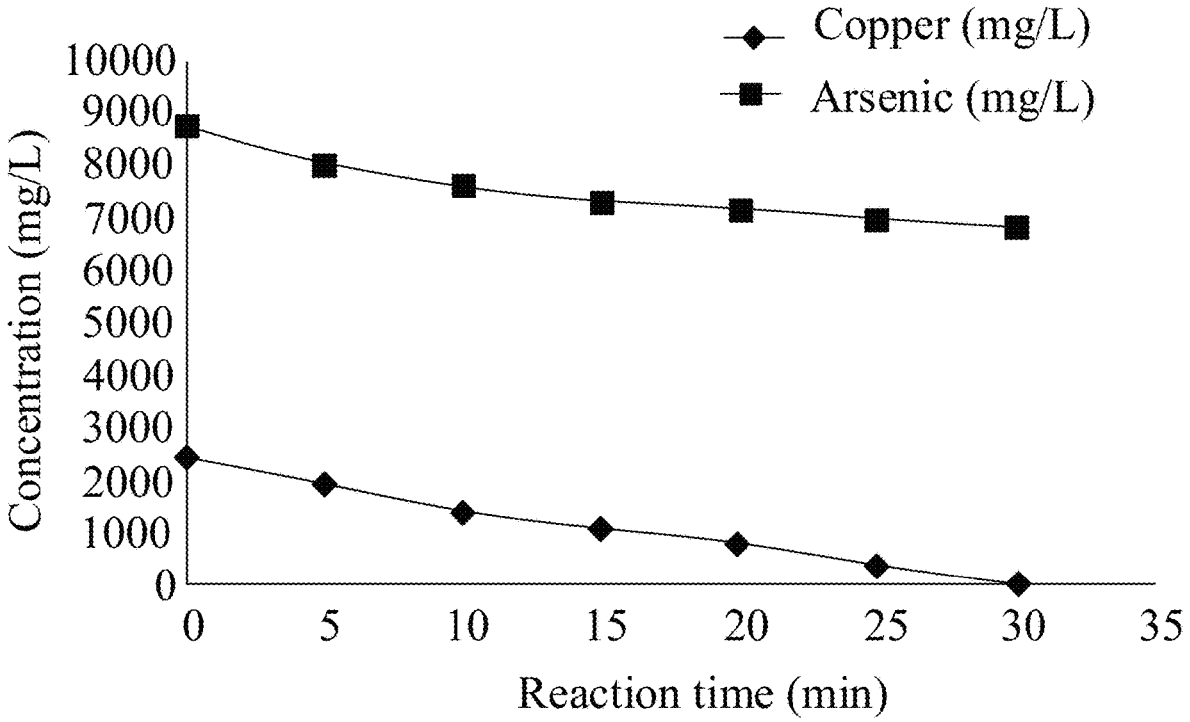
FIG. 3 is a diagram showing changes in copper and arsenic ion concentrations monitored in real time during a second stage sulfidation reaction according to an embodiment of the present disclosure.

Several representative time points are selected from FIG. 3 (see Table 4) for preliminary calculation for determining whether the second stage sulfidation reaction has reached the endpoint.

TABLE 4

| Changes in copper and arsenic ion concentrations monitored in real time in the second stage sulfidation reaction | | | | |
|---|---|---|---|---|
| Species concentration | Time (t) | | | |
| (mg/L) | 0 min | 10 min | 20 min | 30 min |
| Copper ion ($Cu^{2+}$) concentration: C1 | 2400 | 1341 | 750 | 0 |
| Arsenic ion ($As^{5+}$) concentration: c1 | 8700 | 7600 | 7170 | 6800 |

(1) When t=10 min, $Cu^{2+}$=1341 mg/L>0 mg/L (the limit value), the sulfidation endpoint has not been reached, and the reaction continues.

(2) When t=20 min, $Cu^{2+}$=750 mg/L>0 mg/L (the limit value), the sulfidation endpoint has not been reached, and the reaction continues.

(3) When t=30 min, $Cu^{2+}$=0 mg/L (the limit value), the sulfidation endpoint has been reached, and the reaction is terminated for draining and pressure filtration.

At this time point, $Cu^{2+}$ consumed in the reaction precipitation is that $Cu^{2+}$=(2400-0) mg/L=2400 mg/L, and $As^{5+}$ consumed in the reaction precipitation is that: $As^{5+}$=(8700-6800) mg/L=1900 mg/L.

The Cu and As concentrations consumed in the reaction process can be introduced into Formula 3 to obtain the arsenic content in the residue:

$$\frac{1900}{2400\times\frac{64+32}{64}+1900\times\frac{75\times 2+32\times 3}{75\times 2}+1900\times\frac{32\times 2}{75\times 2}}\times 100\% = \frac{1900}{2400\times 1.5+1900\times 1.64+1900\times 0.43}\times 100\% = 25.22\%$$

The Cu and As concentrations consumed in the reaction process can be introduced into formula 4 to obtain the copper content in the residue:

A proportion of Cu in the filter residue is:

$$\frac{Cu}{CuS+As_2S_3+2S}\times 100\% \tag{4}$$

$$\frac{2400}{2400\times\frac{64+32}{64}+1900\times\frac{75\times 2+32\times 3}{75\times 2}+1900\times\frac{32\times 2}{75\times 2}}\times 100\% = \frac{2400}{2400\times 1.5+1900\times 1.64+1900\times 0.43}\times 100\% = 31.86\%$$

In conclusion, the obtained residue contains 31.86% of Cu and 25.22% of As.

3. Third Stage Sulfidation Reaction Process

An electrolyte after the second stage sulfidation is liquid before the third stage sulfidation reaction, with copper and arsenic ion concentrations shown in Table 5.

TABLE 5

| Copper and arsenic ion concentrations in the electrolyte before the third stage sulfidation | |
|---|---|
| Species concentration (mg/L) | Time (t) 0 min |
| Copper ion ($Cu^{2+}$) concentration: C1 | 0 |
| Arsenic ion ($As^{5+}$) concentration: c1 | 6800 |

Finally, the electrolyte after the second stage sulfidation is pumped into the third stage sulfidation reaction tank, and hydrogen sulfide gas is slowly added for sulfidation reaction while the liquid is stirred vigorously.

In the third stage sulfidation reaction process, the changes in copper and arsenic ion concentrations need to be monitored in real time, and the monitored data is fed back to the PLC reaction control module in real time, and it is determined whether a sulfidation reaction endpoint has been reached (limit requirement: the liquid-phase arsenic concentration: $As^{5+}\approx 1000$ mg/L) by rapid calculation and analysis, thereby ensuring that the arsenic concentration in the third stage sulfidation liquid remains consistently within the compliance limit. The variation of the arsenic ion concentration monitored in real time in the third stage sulfidation reaction is shown in FIG. 4.

Figure 4:
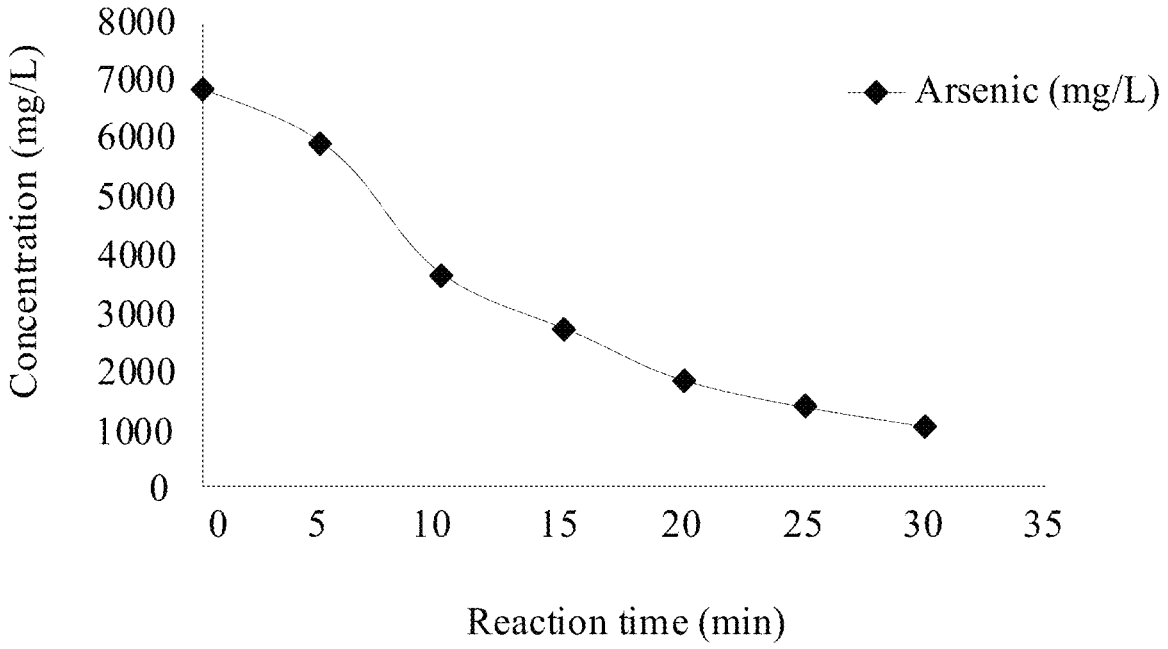
FIG. 4 is a diagram showing changes in copper and arsenic ion concentrations monitored in real time during a third stage sulfidation reaction according to an embodiment of the present disclosure.

Several representative time points are selected from FIG. 4 (see Table 6) for preliminary calculation for determining whether the third stage sulfidation reaction has reached the endpoint.

TABLE 6

Change in copper and arsenic ion concentrations monitored in real time in the third stage sulfidation reaction

| Species concentration (mg/L) | Time (t) 0 min | 10 min | 20 min | 30 min |
|---|---|---|---|---|
| Copper ion ($Cu^{2+}$) concentration: C1 | 0 | 0 | 0 | 0 |
| Arsenic ion ($As^{5+}$) concentration: c1 | 6800 | 3600 | 1800 | 1000 |

(1) When t=10 min, $As^{5+}$=3600 mg/L>1000 mg/L (the limit value), the sulfidation endpoint has not been reached, and the reaction continues.

(2) When t=20 min, $As^{5+}$=1800 mg/L>1000 mg/L (the limit value), the sulfidation endpoint has not been reached, and the reaction continues.

(3) When t=30 min, $As^{5+}$=1000 mg/L, the sulfidation endpoint has been reached, draining and pressure filtration are carried out, and the filtrate is returned to the system.

At this time point, $As^{5+}$ consumed in the reaction precipitation is that $As^{5+}$=6800 mg/L-1000 mg/L-5800 mg/L.

The Cu and As concentrations consumed in the reaction process can be introduced into Formula 3 to obtain the arsenic content in the residue:

$$\frac{5800}{0 \times \frac{64+32}{64} + 5800 \times \frac{75 \times 2 + 32 \times 3}{75 \times 2} + 5800 \times \frac{32 \times 2}{75 \times 2}} \times 100\% = \frac{5800}{0 \times 1.5 + 5800 \times 1.64 + 5800 \times 0.43} \times 100\% = 48.31\%$$

The above description of the embodiments is intended to facilitate the understanding and application of the present disclosure by those of ordinary skill in the art. It is readily apparent to those skilled in the art that various modifications may be made to these embodiments, and the general principles described herein are applied to other embodiments without inventive effort. Therefore, the present disclosure is not limited to the embodiments described here. Any improvements and modifications made by those skilled in the art without departing from the scope of the present disclosure should be within the protection scope of the present disclosure.

What is claimed is:

1. A real-time monitoring method for copper-arsenic sulfidation separation in a copper electrolyte purification process, comprising:

based on a three-stage copper-arsenic sulfidation reaction process:

during a first stage copper-arsenic sulfidation reaction process, monitoring changes in copper and arsenic ion concentrations in the first stage copper-arsenic sulfidation reaction process in real time; by a PLC (programmable logic controller), calculating and determining a critical point where an arsenic concentration slightly decreases, and interlocking a gas inlet valve to close, and a liquid outlet valve to open;

during a second stage copper-arsenic sulfidation reaction process, monitoring changes in copper and arsenic ion concentrations in the second stage copper-arsenic sulfidation reaction process in real time; by the PLC, calculating and determining a critical point where a copper concentration decreases to near zero, and interlocking a gas inlet valve to close, and a liquid outlet valve to open; and during a third stage copper-arsenic sulfidation reaction process, monitoring changes in copper and arsenic ion concentrations in the third stage copper-arsenic sulfidation reaction process in real time; by the PLC, calculating and determining a critical point where the arsenic concentration decreases to a limit value, and interlocking a gas inlet valve to close, and a liquid outlet valve to open, to ensure that the arsenic concentration in a sulfidation liquid discharged from the third stage copper-arsenic sulfidation reaction process remains consistently within a compliance limit.

2. The real-time monitoring method for copper-arsenic sulfidation separation in the copper electrolyte purification process according to claim 1, wherein during the first stage copper-arsenic sulfidation reaction process, monitoring the changes in copper and arsenic ion concentrations over time in a first stage sulfidation reaction tank in real time, the changes comprising a variation of the copper ion over sulfidation time from liquid inlet to liquid outlet and a variation of the arsenic ion over sulfidation time from liquid inlet to liquid outlet, and transmitting data to the PLC in real time; when analyzing and determining the critical point where the arsenic ion concentration slightly decreases in the first stage copper-arsenic sulfidation reaction process, interlocking, by the PLC, the gas inlet valve of the first stage sulfidation reaction tank to close, and the liquid outlet valve of the first stage sulfidation reaction tank to open to terminate the reaction.

3. The real-time monitoring method for copper-arsenic sulfidation separation in the copper electrolyte purification process according to claim 1, wherein during the second stage copper-arsenic sulfidation reaction process, monitoring the changes in copper and arsenic ion concentrations over time in a second stage sulfidation reaction tank in real time, the changes comprising a variation of the copper ion over sulfidation time from liquid inlet to liquid outlet and a variation of the arsenic ion over sulfidation time from liquid inlet to liquid outlet, and transmitting data to the PLC in real time; when analyzing and determining the critical point where the copper ion concentration decreases to near zero in the second stage copper-arsenic sulfidation reaction process, interlocking, by the PLC, the gas inlet valve of the second stage sulfidation reaction tank to close, and the liquid outlet valve of the second stage sulfidation reaction tank to open to terminate the reaction.

4. The real-time monitoring method for copper-arsenic sulfidation separation in the copper electrolyte purification process according to claim 1, wherein during the third stage copper-arsenic sulfidation reaction process, monitoring the changes in copper and arsenic ion concentrations over time in a third stage sulfidation reaction tank in real time, the changes comprising a variation of the copper ion over sulfidation time from liquid inlet to liquid outlet and a variation of the arsenic ion over sulfidation time from liquid inlet to liquid outlet, and transmitting data to the PLC in real time; when analyzing and determining the critical point where the arsenic ion concentration decreases to the limit value in the third stage copper-arsenic sulfidation reaction process, interlocking, by the PLC, the gas inlet valve of the third stage sulfidation reaction tank to close, and the liquid outlet valve of the third stage sulfidation reaction tank to open to terminate the reaction, thereby ensuring that the arsenic concentration in the discharged third stage sulfidation liquid remains consistently within the compliance limit.

5. The real-time monitoring method for copper-arsenic sulfidation separation in the copper electrolyte purification process according to claim 2, wherein the critical point where the arsenic ion concentration slightly decreases in the first stage copper-arsenic sulfidation reaction process is that arsenic content is less than or equal to 2.5%.

6. The real-time monitoring method for copper-arsenic sulfidation separation in the copper electrolyte purification process according to claim 3, wherein the critical point where the copper ion concentration decreases to a limit value in the second stage copper-arsenic sulfidation reaction process is 0 mg/L.

7. The real-time monitoring method for copper-arsenic sulfidation separation in the copper electrolyte purification process according to claim 4, wherein the critical point where the arsenic ion concentration decreases to the limit value in the third stage copper-arsenic sulfidation reaction process is 1000 mg/L.

8. A real-time monitoring system for copper-arsenic sulfidation separation in a copper electrolyte purification process, comprising a first stage sulfidation reaction tank, a second stage sulfidation reaction tank, and a third stage sulfidation reaction tank, wherein the system further comprises a PLC reaction control module, a first stage sulfidation real-time monitoring module, a second stage sulfidation real-time monitoring module, a third stage sulfidation real-time monitoring module, and a hydrogen sulfide inlet valve and sulfidation liquid outlet valve;

wherein the PLC reaction control module comprises a first stage sulfidation copper-arsenic reaction closed-loop control module, a second stage sulfidation copper-arsenic reaction closed-loop control module, and a third stage sulfidation copper-arsenic reaction closed-loop control module;

the first stage sulfidation copper-arsenic reaction closed-loop control module is in communication and electrical connection with the first stage sulfidation real-time monitoring module and the hydrogen sulfide inlet valve and sulfidation liquid outlet valve, and is configured to retrieve copper and arsenic ion concentrations of the first stage sulfidation real-time monitoring module in real time, and to interlock a first stage sulfidation reaction tank hydrogen sulfide inlet electromagnetic valve in the hydrogen sulfide inlet valve and sulfidation liquid outlet valve to close and a first stage sulfidation reaction tank sulfidation liquid outlet ball valve in the hydrogen sulfide inlet valve and sulfidation liquid outlet valve to open when analyzing and determining a critical point where the arsenic ion concentration slightly decreases in a first stage sulfidation process, thereby terminating the reaction;

the second stage sulfidation copper-arsenic reaction closed-loop control module is in communication and electrical connection with the second stage sulfidation real-time monitoring module and the hydrogen sulfide inlet valve and sulfidation liquid outlet valve, and is configured to retrieve copper and arsenic ion concentrations of the second stage sulfidation real-time monitoring module in real time, and to interlock a second stage sulfidation reaction tank hydrogen sulfide inlet electromagnetic valve in the hydrogen sulfide inlet valve and sulfidation liquid outlet valve to close and a second stage sulfidation reaction tank sulfidation liquid outlet ball valve in the hydrogen sulfide inlet valve and sulfidation liquid outlet valve to open when analyzing and determining a critical point where the copper ion concentration decreases to near zero in a second stage sulfidation process, thereby terminating the reaction;

the third stage sulfidation copper-arsenic reaction closed-loop control module is in communication and electrical connection with the third stage sulfidation real-time monitoring module and the hydrogen sulfide inlet valve and sulfidation liquid outlet valve, and is configured to retrieve copper and arsenic ion concentrations of the third stage sulfidation real-time monitoring module in real time, and to interlock a third stage sulfidation reaction tank hydrogen sulfide inlet electromagnetic valve in the hydrogen sulfide inlet valve and sulfidation liquid outlet valve to close and a third stage sulfidation reaction tank sulfidation liquid outlet ball valve in the hydrogen sulfide inlet valve and sulfidation liquid outlet valve to open when analyzing and determining a critical point where the arsenic ion concentration decreases to a limit value in a third stage sulfidation process, thereby terminating the reaction;

the first stage sulfidation real-time monitoring module) is mounted at the first stage sulfidation reaction tank, and configured to monitor the changes in copper and arsenic ion concentrations over time in the first stage sulfidation process, with a focus on monitoring the critical point where the arsenic ion concentration starts to slightly decrease, wherein a corresponding reaction time of the critical point is a reaction endpoint draining time; to monitor a variation of the copper ion over sulfidation time from liquid inlet to liquid outlet and a variation of the arsenic ion over the sulfidation time from liquid inlet to liquid outlet in real time, and transmit data to the first stage sulfidation copper-arsenic reaction closed-loop control module in the PLC reaction control module in real time;

the second stage sulfidation real-time monitoring module is mounted at the second stage sulfidation reaction tank, and configured to monitor the changes in copper and arsenic ion concentrations over time in the second stage sulfidation process, with a focus on monitoring the critical point where the copper ion concentration decreases to near zero, wherein a corresponding reaction time of the critical point is the reaction endpoint draining time; to monitor the variation of the copper ion over the sulfidation time from liquid inlet to liquid outlet and the variation of the arsenic ion over the sulfidation time from liquid inlet to liquid outlet in real time, and transmit data to the second stage sulfidation copper-arsenic reaction closed-loop control module in the PLC reaction control module in real time;

the third stage sulfidation real-time monitoring module is mounted at the third stage sulfidation reaction tank, and configured to monitor the changes in copper and arsenic ion concentrations over time in the third stage sulfidation process, with a focus on monitoring the critical point where the arsenic ion concentration decreases to the limit value, wherein a corresponding reaction time of the critical point is the reaction endpoint draining time; to monitor the variation of the copper ion over the sulfidation time from liquid inlet to liquid outlet and the variation of the arsenic ion over the sulfidation time from liquid inlet to liquid outlet in real time, and transmit data to the third stage sulfidation copper-arsenic reaction closed-loop control module in the PLC reaction control module in real time;

the hydrogen sulfide inlet valve and sulfidation liquid outlet valve comprises the first stage sulfidation reaction tank hydrogen sulfide inlet electromagnetic valve and the first stage sulfidation reaction tank sulfidation liquid outlet ball valve, the second stage sulfidation reaction tank hydrogen sulfide inlet electromagnetic valve and the second stage sulfidation reaction tank sulfidation liquid outlet ball valve, and the third stage sulfidation reaction tank hydrogen sulfide inlet electromagnetic valve and the third stage sulfidation reaction tank sulfidation liquid outlet ball valve;

the first stage sulfidation reaction tank hydrogen sulfide inlet electromagnetic valve and the first stage sulfidation reaction tank sulfidation liquid outlet ball valve are mounted at the first stage sulfidation reaction tank, and are correspondingly opened and closed in response to an instruction from the first stage sulfidation copper-arsenic reaction closed-loop control module in the PLC reaction control module;

the second stage sulfidation reaction tank hydrogen sulfide inlet electromagnetic valve and the second stage sulfidation reaction tank sulfidation liquid outlet ball valve are mounted at the second stage sulfidation reaction tank, and are correspondingly opened and closed in response to an instruction from the second stage sulfidation copper-arsenic reaction closed-loop control module in the PLC reaction control module; and the third stage sulfidation reaction tank hydrogen sulfide inlet electromagnetic valve and the third stage sulfidation reaction tank sulfidation liquid outlet ball valve are mounted at the third stage sulfidation reaction tank, and are correspondingly opened and closed in response to an instruction from the third stage sulfidation copper-arsenic reaction closed-loop control module in the PLC reaction control module.

* * * * *